US010751794B2

(12) United States Patent
Nishida et al.

(10) Patent No.: US 10,751,794 B2
(45) Date of Patent: Aug. 25, 2020

(54) MOLTEN METAL POURING DEVICE AND MOLTEN METAL POURING METHOD

(71) Applicants: SINTOKOGIO, LTD., Nagoya-shi, Aichi (JP); Fujiwa Denki Co., Ltd., Nagoya-shi, Aichi (JP)

(72) Inventors: Tadashi Nishida, Nagoya (JP); Toshiyuki Hyodo, Nagoya (JP); Koichi Banno, Nagoya (JP)

(73) Assignees: SINTOKOGIO, LTD., Nagoya-shi, Aichi (JP); FUJIWA DENKI CO., LTD., Nagoya-shi, Aichi (JP)

( * ) Notice: Subject to any disclaimer, the term of this patent is extended or adjusted under 35 U.S.C. 154(b) by 522 days.

(21) Appl. No.: 15/544,371

(22) PCT Filed: Feb. 17, 2016

(86) PCT No.: PCT/JP2016/054569
§ 371 (c)(1),
(2) Date: Jul. 18, 2017

(87) PCT Pub. No.: WO2016/158055
PCT Pub. Date: Oct. 6, 2016

(65) Prior Publication Data

US 2018/0009027 A1 Jan. 11, 2018

(30) Foreign Application Priority Data

Apr. 3, 2015 (JP) ..... 2015-076976

(51) Int. Cl.
*B22D 37/00* (2006.01)
*B22D 41/06* (2006.01)
*B22D 39/04* (2006.01)

(52) U.S. Cl.
CPC ..... *B22D 37/00* (2013.01); *B22D 41/06* (2013.01); *B22D 39/04* (2013.01)

(58) Field of Classification Search
CPC ..... B22D 37/00; B22D 41/06; B22D 39/04
See application file for complete search history.

(56) References Cited

U.S. PATENT DOCUMENTS 5,758,714 A 6/1998 Sato et al.
2013/0140335 A1* 6/2013 Banno ..... B22D 37/00 222/590

FOREIGN PATENT DOCUMENTS

CN 101244457 A 8/2008
CN 102883838 A 1/2013
(Continued)

OTHER PUBLICATIONS

International Preliminary Report on Patentability dated Oct. 12, 2017 for PCT/JP2016/054569.

*Primary Examiner* — Scott R Kastler
(74) *Attorney, Agent, or Firm* — Faegre Drinker Biddle & Reath LLP

(57) ABSTRACT

A pouring apparatus comprises a ladle configured to include a body and a nozzle, and a controller configured to control a tilt angle of the ladle, wherein the body includes a side face portion, an inner surface of the side face portion is formed in a cylindrical shape or in a conical shape, the nozzle includes a nozzle tip for guiding molten metal to the outside and is integrated with the body on a side of the body, in order to guide the molten metal in the body to the nozzle tip and to pour out the molten metal through the nozzle tip, and the controller controls the tilt angle on the basis of a surface area of the molten metal when the ladle is tilted.

19 Claims, 15 Drawing Sheets

(56) References Cited

FOREIGN PATENT DOCUMENTS

| | | | |
|---|---|---|---|
| CN | 203209679 | U | 9/2013 |
| CN | 203253907 | U | 10/2013 |
| JP | S51-052333 | A | 5/1976 |
| JP | S54-149326 | A | 11/1979 |
| JP | S62-57758 | A | 3/1987 |
| JP | H06-7919 | A | 1/1994 |
| JP | H07-112270 | A | 5/1995 |
| JP | H07-266027 | A | 10/1995 |
| JP | H09-1320 | A | 1/1997 |
| JP | 2000-326063 | A | 11/2000 |
| JP | 3361369 | B2 | 1/2003 |
| JP | 2010-253527 | A | 11/2010 |
| JP | 2011-224631 | A | 11/2011 |
| WO | WO 2008/099556 | A1 | 8/2008 |
| WO | WO-2011/004685 | A1 | 1/2011 |
| WO | WO 2014/174977 | A1 | 10/2014 |

* cited by examiner (a)

(b)

MOLTEN METAL POURING DEVICE AND MOLTEN METAL POURING METHOD

TECHNICAL FIELD

The present disclosure relates to a pouring apparatus and a pouring method, for pouring out molten metal into a mold by tilting a ladle such that a molten metal pouring position in which molten metal is poured from a nozzle of the ladle is maintained at a predetermined position.

BACKGROUND ART

In a foundry, molten metal at a high temperature, melted in a melting furnace is received by a ladle, and the ladle is conveyed to a pouring place so that a cast product is manufactured by pouring the molten metal into a mold from the conveyed ladle. There is known a technique in which pouring of molten metal into a mold from a ladle as described above is automated instead of manual operation. For example, a tilting pouring apparatus shown in Patent Document 1 achieves automation and improves work environment. This device uses a fan-shaped ladle, and tilts the fan-shaped ladle such that a molten metal pouring position is maintained at a predetermined position. Accordingly, pouring of molten metal is automated.

CITATION LIST

Patent Document

Patent Document 1: Japanese Patent No. 3361369

SUMMARY OF INVENTION

Technical Problem

The fan-shaped ladle has an advantage in that a flow rate of pouring of molten metal can be easily controlled because a surface area of a top face of molten metal in the fan-shaped ladle is constant regardless of a tilt angle to enable pouring of molten metal at a flow rate in proportion to tilt angular speed. Meanwhile, there is a problem in that temperature of the molten metal is liable to decrease because a contact area between the molten metal and an air is larger than that of a cylindrical ladle and the like. Decrease in temperature of the molten metal may affect quality of a cast product. In addition, there is also a problem in that manufacturing cost of the fan-shaped ladle is more than that of a cylindrical ladle.

In the present technical field, there is desired a pouring apparatus and pouring method that can not only control a flow rate of pouring of molten metal to enable pouring of the molten metal on a desired molten metal pouring pattern, but also achieve appropriate automatic pouring of the molten metal by controlling the flow rate of pouring of the molten metal, even if the ladle in a shape other than the fan-shaped ladle (e.g. a cylindrical ladle) is used.

Solution to Problem

A pouring apparatus according to an aspect of the present invention pours out molten metal by tilting a ladle such that a molten metal pouring position from a nozzle of the ladle is maintained at a predetermined position, and comprises the ladle having a body and the nozzle, and a controller controlling a tilt angle of the ladle, wherein the body includes a side face portion with an inner surface in a cylindrical shape or in a conical shape, the nozzle is integrated with the body on a side of the body and includes a nozzle tip for guiding molten metal to the outside to guide molten metal in the body to the nozzle tip as well as to pour out the molten metal through the nozzle tip, and the controller controls the tilt angle of the ladle on the basis of a surface area of molten metal when the ladle is tilted.

In addition, a pouring method according to another aspect of the present invention is a molten metal pouring method of pouring molten metal by using a pouring apparatus that pours out molten metal by tilting a ladle such that a molten metal pouring position from a nozzle of the ladle is maintained at a predetermined position, and the pouring apparatus comprises the ladle having a body and the nozzle, and a controller controlling a tilt angle of the ladle, wherein the body includes a side face portion with an inner surface in a cylindrical shape or in a conical shape, the nozzle is integrated with the body on a side of the body and includes a nozzle tip for guiding molten metal to the outside to guide molten metal in the body to the nozzle tip as well as to pour out the molten metal through the nozzle tip, and the pouring method allows the controller to control the tilt angle of the ladle on the basis of a surface area of molten metal when the ladle is tilted so that the molten metal is poured out from the ladle.

Advantageous Effects of Invention

Various aspects of the present invention each achieve not only control of a flow rate of pouring of molten metal for enabling pouring of molten metal on a desired molten metal pouring pattern, but also appropriate automatic pouring of molten metal by controlling the flow rate of pouring of molten metal.

DESCRIPTION OF EMBODIMENTS

An automatic pouring apparatus (hereinafter referred to as a "pouring apparatus") according to the present embodiment will be described below with reference to accompanying drawings. A pouring apparatus 1 described below is a pouring apparatus configured to pour out molten metal by tilting a ladle such that a molten metal pouring position from a nozzle of the ladle is maintained at a predetermined position.

Figure 1:
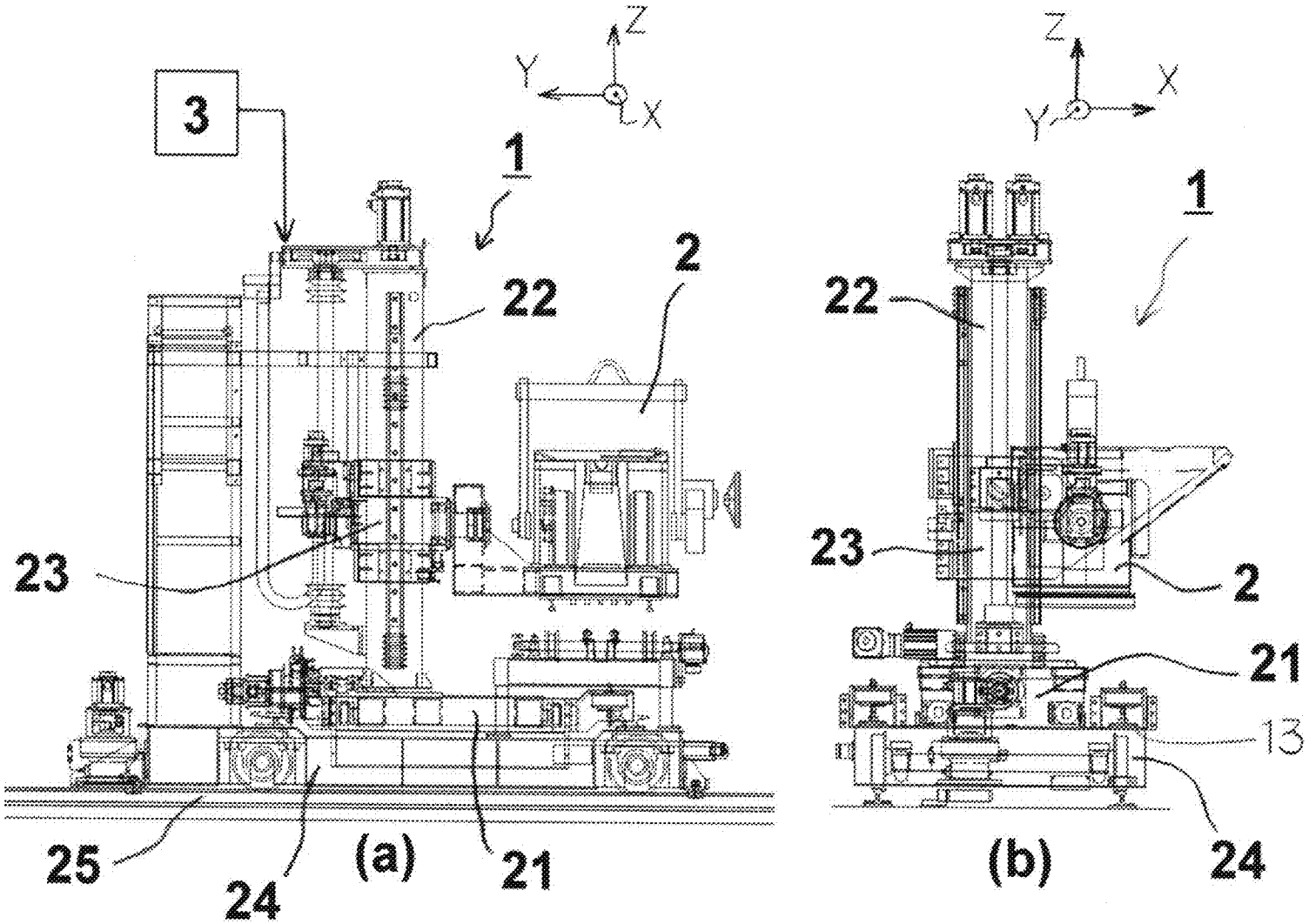
FIG. 1 includes a portion (a) that is a front view of a pouring apparatus according to an embodiment, and a portion (b) that is a side view of the pouring apparatus according to the embodiment.
Figure 2:
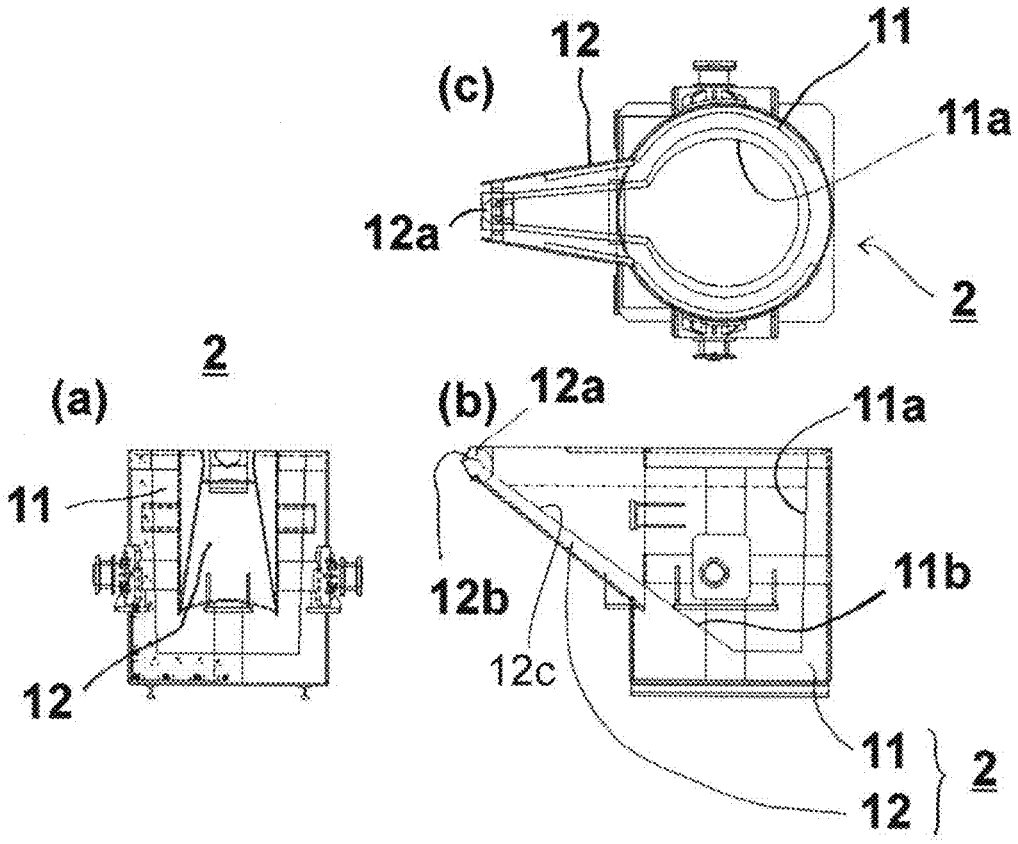
FIG. 2 includes a portion (a) that is a front view of a ladle, a portion (b) that is a side view thereof, and a portion (c) that is a plan view thereof.

FIG. 1 includes a portion (a) that is a front view of the pouring apparatus 1 according to the present embodiment, and a portion (b) that is a side view thereof. FIG. 2 includes a portion (a) that is a front view of a ladle 2, a portion (b) that is a side view thereof, and a portion (c) that is a plan view thereof. The pouring apparatus 1 includes the ladle 2 provided with a body 11 and a nozzle 12, and a controller 3 (central processing unit) that controls a tilt angle of the ladle 2, as illustrated in the portion (a) of FIG. 1 to the portion (c) of FIG. 2. The body 11 includes a side face portion 11*a* with an inner surface in a cylindrical shape or in a conical shape. The nozzle 12 includes a nozzle tip 12*a* provided at the one end thereof, and is integrated with the body 11 on a side of the body 11. That is, a space for storing molten metal is defined by an inner surface of each of the body 11 and the nozzle 12. The nozzle 12 guides molten metal in the body 11 to the nozzle tip 12*a*, and pours out the molten metal through the nozzle tip 12*a*. The controller 3 controls a tilt angle of the ladle 2 on the basis of a surface area of molten metal when the ladle 2 is tilted. In the ladle 2, a rotation mechanism 23 described below is provided such that its rotation axis extends in a direction (a Y-direction in each of the portions (a) and (b) of FIG. 1) orthogonal to a juxtaposed direction (an X-direction in each of the portions (a) and (b) of FIG. 1) of the body 11 and the nozzle 12. That is, the ladle 2 tilts in a ZX-plane in each of the portions (a) and (b) of FIG. 1. Inside the nozzle 12, a space for storing molten metal is defined while communicating with the body 11.

Figure 3:
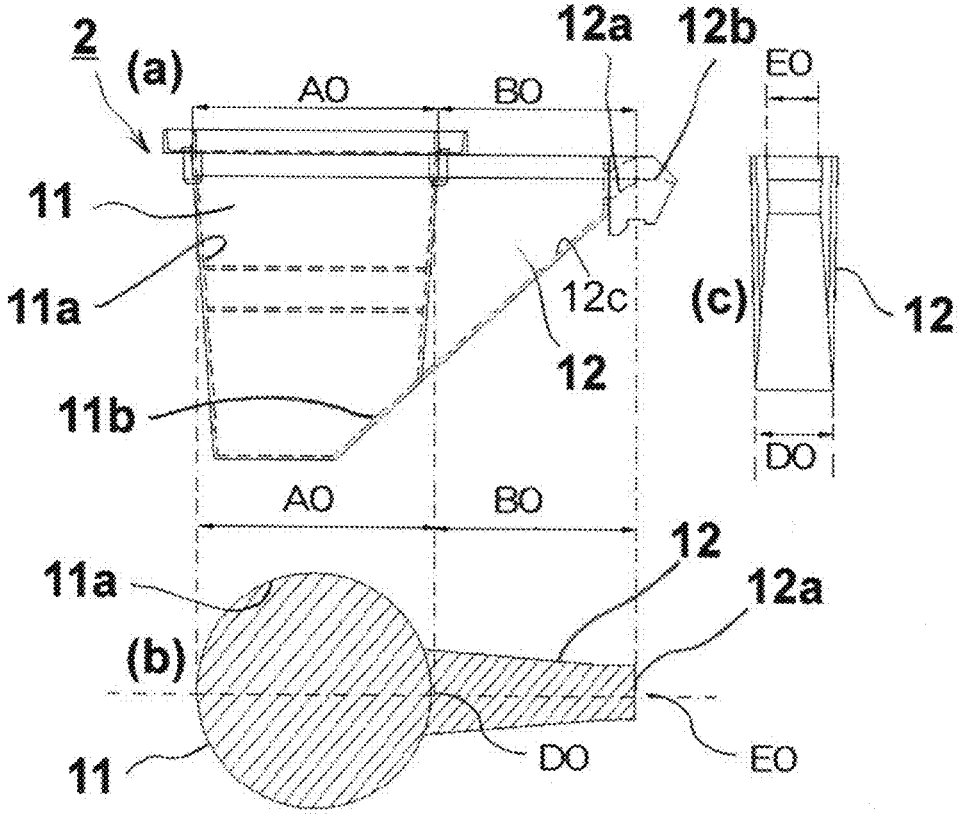
FIG. 3 includes a portion (a) that is a side sectional view of the ladle, a portion (b) that illustrates a surface area of the ladle in a horizontal position, and a portion (c) that illustrates a nozzle as viewed from a nozzle tip side.

FIG. 3 includes a portion (a) that is side sectional view of the ladle 2, a portion (b) that illustrates a surface area of molten metal in a horizontal position of the ladle 2, and a portion (c) that illustrates the nozzle 12 as viewed from a nozzle tip 12*a* side. The nozzle 12 is formed such that its inner surface causes a surface area of molten metal stored in the nozzle 12 to be in the shape of a trapezoid or a rectangle as viewed from a vertical direction (a Z-direction in each of the portions (a) and (b) of FIG. 1) when the ladle 2 is not tilted, as illustrated in the portions (a) to (c) of FIG. 3 (an example of a trapezoid is described here as illustrated in the portion (b) of FIG. 3). At the same time, the nozzle 12 is formed such that its inner surface causes the surface area of the molten metal stored in the nozzle 12 to be in the shape of a trapezoid or a rectangle as viewed from the vertical direction when the ladle 2 is tilted to pour out the molten metal through the nozzle tip 12*a*.

The body 11 is formed such that a surface area of molten metal in the body 11 is in the shape of a circle as viewed from the vertical direction when the ladle 2 is not tilted and in a state where molten metal remains little in the nozzle 12. The body 11 has a surface area of molten metal in a state where a part of a circle is missing in a second inner side face portion 11*b* described below as viewed from the vertical direction when the ladle 2 is not tilted and in a state where molten metal decreases to a level where no molten metal exists in the nozzle 12.

The body 11 has a surface area of molten metal in the body 11 that is in the shape of an ellipse as viewed from the vertical direction or an ellipse with missing part as viewed from the vertical direction (e.g. a portion (c) of FIG. 6 described below) when the ladle 2 is tilted to pour out the molten metal through the nozzle tip 12*a*. The missing part is due to the molten metal decreasing such that the bottom of the tilted body is no longer covered.

The body 11 includes a second inner side face portion lib aligning with an inner surface bottom portion 12*c* of the nozzle 12 (refer to the portion (b) of FIG. 2 and the portion (a) of FIG. 3) in a section (a section taken along the ZX-plane) orthogonal to a tilt center axis described below extending in the Y-direction.

A curved surface 12*b* with a predetermined curvature radius for forming a flow of molten metal is formed on a leading end side of the inner surface bottom portion 12*c* of the nozzle tip 12*a*. The ladle 2 is tilted such that an axis extending in the Y-direction through a curvature center of the curved surface 12*b* in the section taken along the ZX-plane serves as the tilt center axis.

Figure 7:
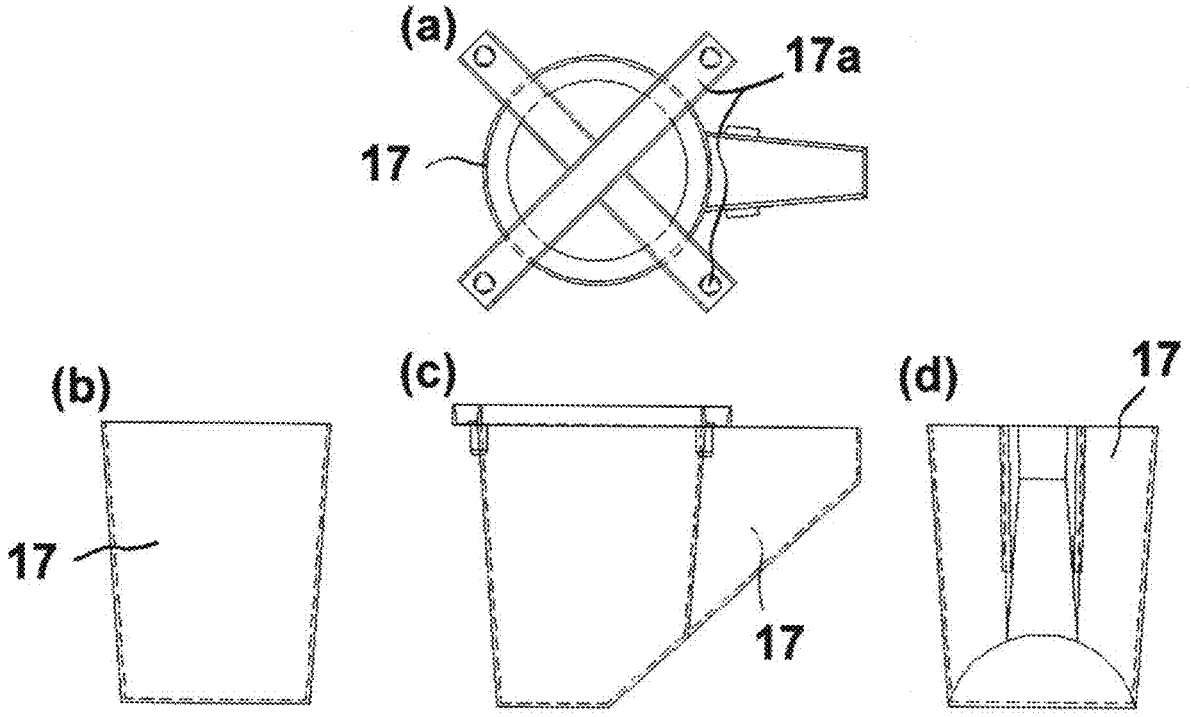
FIG. 7 includes a portion (a) that is a plan view of a cast mold for the ladle, a portion (b) that is a rear view thereof, a portion (c) that is a side view thereof, and a portion (d) that is a front view thereof.
Figure 8:
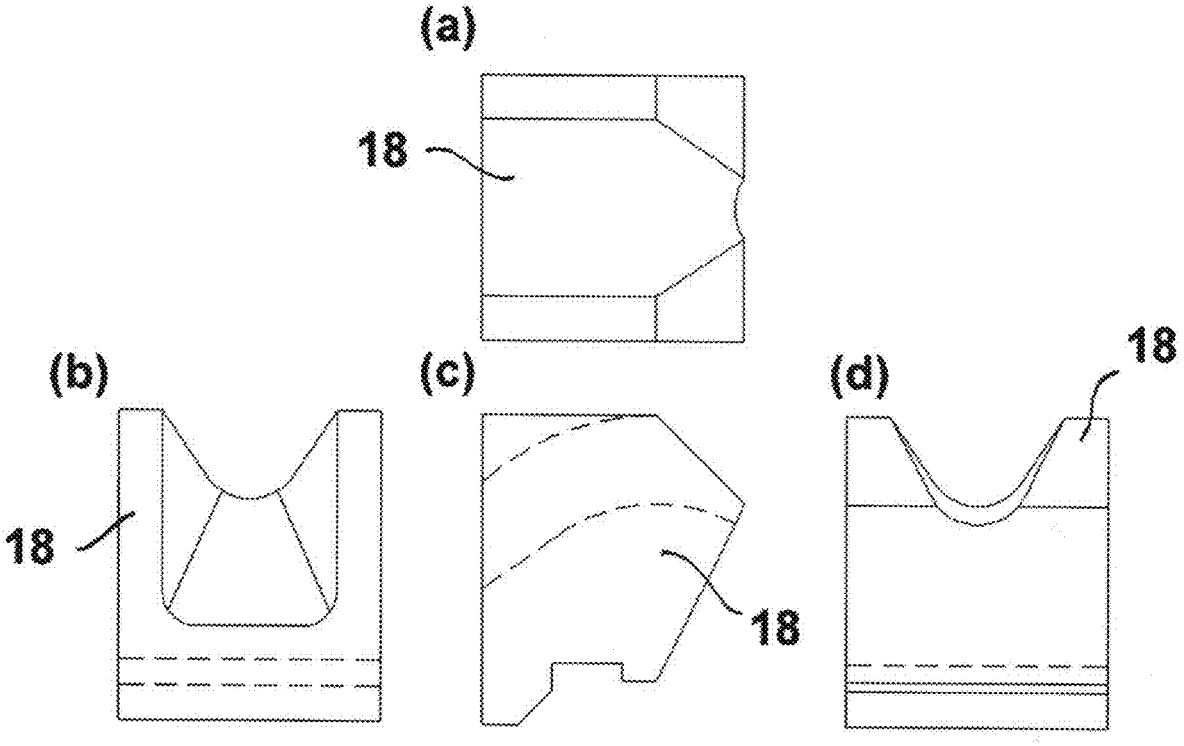
FIG. 8 includes a portion (a) that is a plan view of a pattern for the nozzle of the ladle, a portion (b) that is a rear view thereof, and a portion (c) that is a side view thereof, and a portion (d) that is a front view thereof.

The ladle 2 has an inner surface molded by using a mold for molding an inner surface of the body 11 and the nozzle 12 in a uniform shape. A portion (a) of FIG. 7 is a plan view of a cast mold for the ladle 2, a portion (b) of FIG. 7 is a rear view thereof, a portion (c) of FIG. 7 is a side view thereof, and a portion (d) of FIG. 7 is a front view thereof. For example, a cast mold 17 called a "former" as illustrated in the portions (a) to (d) of FIG. 7 is prepared for the body 11, and the inner surface of the body 11 can be formed in a uniform shape by pouting refractory material into a space between a shell of the ladle and the mold (former). The cast mold 17 includes a position determining part 17*a* for determining a position with respect to the shell of the ladle. A portion (a) of FIG. 8 is a plan view of a pattern 18 for the nozzle of the ladle 2, a portion (b) of FIG. 8 is a rear view thereof, a portion (c) of FIG. 8 is a side view thereof, and a portion (d) of FIG. 8 is a front view thereof. The nozzle 12 also tends to be changed in shape due to adhesion of slag and cleaning of the slag, and thus is molded by using the pattern 18 as illustrated in FIG. 8 to form its shape. The mold described above enables the inner surface of the ladle to be maintained in a uniform shape, and achieves pouring out of molten metal from an accurate molten metal pouring position.

Figure 9:
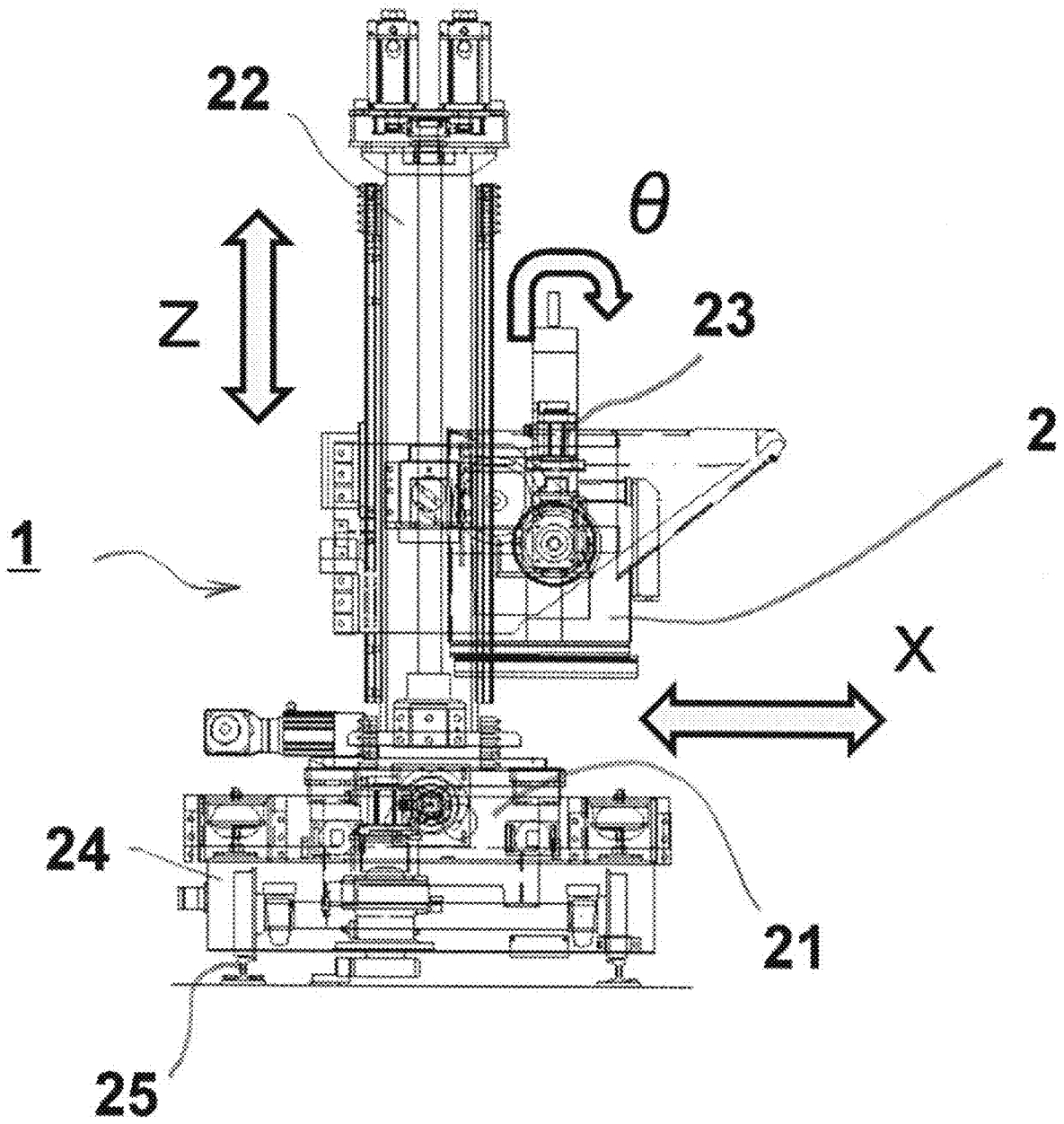
FIG. 9 is a side view (corresponding to the portion (b) of FIG. 1) of the pouring apparatus, illustrating a lifting axis, a fore-and-aft axis, and a rotation axis, as a drive axis of the ladle.

FIG. 9 is a side view (corresponding to the portion (b) of FIG. 1) of the pouring apparatus 1, illustrating a lifting axis, a fore-and-aft axis, and a rotation axis, as a drive axis of the ladle 2. The pouring apparatus 1 includes a horizontal movement mechanism 21, a lifting mechanism (a vertical movement mechanism) 22, and a rotation mechanism 23, as illustrated in FIG. 9. The horizontal movement mechanism 21 drives the ladle 2 in a first direction (X-direction) that is a horizontal direction as well as a direction approaching and away from a mold. The lifting mechanism 22 drives the ladle 2 in a second direction (Z-direction) that is a vertical direction. The rotation mechanism 23 rotates the ladle 2 around a rotation axis that is parallel to a third direction (Y-direction) orthogonal to the first direction (X-direction) and the second direction (Z-direction), and that passes through the center of gravity of the ladle. The horizontal movement mechanism 21, the lifting mechanism 22, and the rotation mechanism 23 drive the ladle 2 to tilt the ladle 2 such that an axis extending in the Y-direction through the curvature center (the curvature center of the curved surface 12*b* of the nozzle tip 12*a*) serves as the tilt center axis. Then, a molten metal pouring out point P is also to be a predetermined position.

In addition, the pouring apparatus 1 includes a traveling car truck 24 that travels along the mold to be conveyed in an aligned manner. The traveling car truck 24 travels on a rail 25 provided along the mold that is to be conveyed in an aligned manner. The horizontal movement mechanism 21 is provided in the traveling car truck 24 to move the ladle 2 in a direction (the X-direction, or a fore-and-aft direction) orthogonal to a traveling direction (the Y-direction) of the traveling car truck. The lifting mechanism 22 is provided in the horizontal movement mechanism 21 to move the ladle 2 in the vertical direction (the Z-direction, or an up-and-down direction). The rotation mechanism 23 is provided in the lifting mechanism 22 to rotate the ladle 2 in the rotation direction described above.

Figure 10:
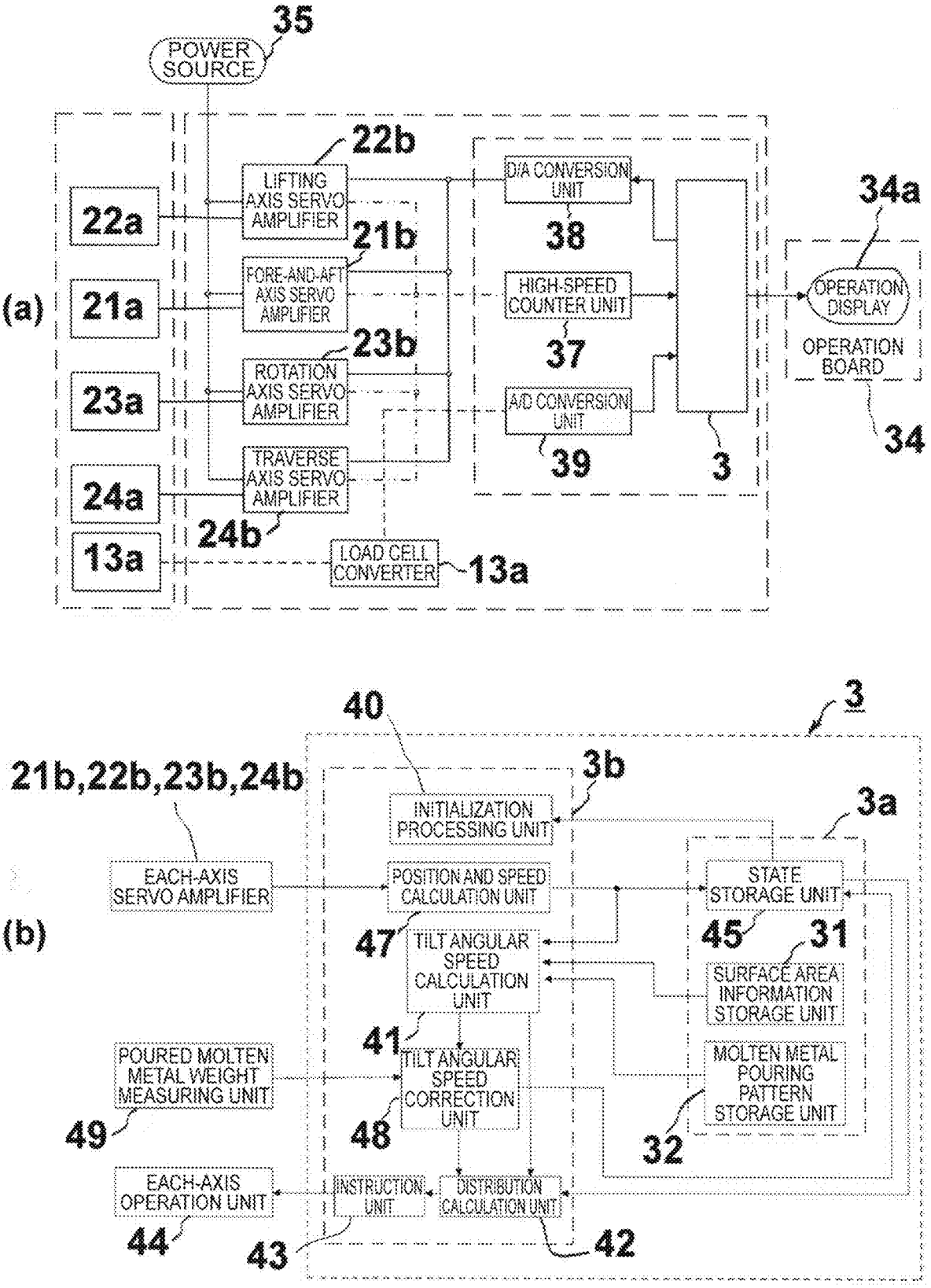
FIG. 10 includes a portion (a) that is a block diagram of a control system of the pouring apparatus, and a portion (b) that is a block diagram illustrating details of a processing unit.

A portion (b) of FIG. 10 is a block diagram illustrating details of a processing unit. The pouring apparatus 1 includes a surface area information storage unit 31 that stores a surface area of molten metal that is previously calculated in accordance with a tilt angle of the ladle 2, and a molten metal pouring pattern storage unit 32 that stores information on a molten metal pouring pattern that is a pattern of a flow rate of pouring of molten metal, corresponding to each mold to be conveyed, as illustrated in the portion (b) of FIG. 10.

The controller 3 controls tilt operation of the ladle 2 such that molten metal is poured into a mold on a molten metal pouring pattern corresponding to a kind of product on the basis of the information on a molten metal pouring pattern (flow rate pattern), corresponding to each mold, stored in the molten metal pouring pattern storage unit 32, and information stored in the surface area information storage unit 31.

In addition, the pouring apparatus 1 includes a weight detection unit 13 that detects weight of molten metal in the ladle 2, as illustrated in the portion (b) of FIG. 1. The weight detection unit 13 is a load cell, for example. The controller 3 controls tilt operation of the ladle 2 by feedback control on the basis of information from the weight detection unit 13.

As described above, the pouring apparatus 1 achieves not only control of a flow rate of pouring of molten metal so that molten metal can be poured on a desired molten metal pouring pattern (flow rate pattern) even in a ladle (a ladle in which a surface area of molten metal changes in accordance with a tilt angle) other than a ladle (fan-shaped ladle) in which a surface area of molten metal is not changed even if the ladle is tilted, but also appropriate automatic pouring of molten metal by controlling a flow rate of pouring of molten metal. This enables automatization, improvement in work environment, energy saving, and improvement in quality to be achieved. In addition, decrease in molten metal temperature caused by a ladle shape can be prevented, as well as increase in manufacturing cost caused by the ladle shape can be prevented, for example.

Next, a pouring method using the pouring apparatus 1 will be described. The pouring method is a pouring method of pouring molten metal by using the pouring apparatus 1 that pours out molten metal by tilting the ladle 2 so that a molten metal pouring position from the nozzle 12 of the ladle 2 is maintained at a predetermined position. In the pouring method, the controller 3 controls a tilt angle of the ladle 2 on the basis of a surface area of molten metal when the ladle 2 is tilted such that molten metal is poured from the ladle. The method achieves not only control of a flow rate of pouring of molten metal for enabling pouring of molten metal on a desired pouring pattern of molten metal, but also appropriate automatic pouring of molten metal by controlling the flow rate of pouring of molten metal. This enables automatization, improvement in work environment, energy saving, and improvement in quality to be achieved.

While in the description above, there are described the pouring apparatus 1 and the pouring method, using the ladle 2 with the side face portion 11*a* having an inner surface in a cylindrical shape or in a conical shape, the present invention is not limited to the ladle 2, and any ladle in which a surface area of molten metal can be calculated or measured when a ladle is tilted can be used. That is, a pouring apparatus for pouring out molten metal by tilting a ladle such that a molten metal pouring position from a nozzle of the ladle is maintained at a predetermined position may be configured to include the ladle having the body and the nozzle, and a controller controlling a tilt angle of the ladle, wherein the controller controls a tilt angle of the ladle on the basis of a surface area of molten metal when the ladle is tilted. The pouring apparatus also achieves control of a flow rate of pouring of molten metal, and achieves appropriate automatic pouring of molten metal, for example.

In addition, the pouring apparatus 1 may comprise a state storage unit 45 storing various states, in addition to the surface area information storage unit 31 and the molten metal pouring pattern storage unit 32, described above, as illustrated in the portion (b) of FIG. 10, wherein the controller 3 may not only read out a current tilt angle of the ladle 2 stored in the state storage unit 45 and a surface area inverse ratio corresponding to the current tilt angle from the surface area information storage unit 31, but also calculate current virtual tilt angular speed to be a target (virtual angular speed required for achieving a desired flow rate of pouring of molten metal) from a molten metal pouring pattern stored in the molten metal pouring pattern storage unit 32 to calculate tilt angular speed required for the ladle 2 (target tilt angular speed Vθ(t) described below) on the basis of the matters above. This enables the pouring apparatus 1 to pour molten metal on an appropriate molten metal pouring pattern, and achieves appropriate automatic pouring of molten metal, for example.

The molten metal pouring pattern stored in the molten metal pouring pattern storage unit 32 corresponds to each mold, and is information showing change in virtual tilt angular speed with elapsed time (e.g. FIG. 12 described below). The virtual tilt angular speed is angular speed in a case where a surface area of a mold is converted into a reference surface area (e.g. a surface area in a horizontal position is to be reference) on the basis of information on the surface area of a mold (e.g. portions (a) and (b) of FIG. 11). In addition, the virtual tilt angular speed is tilt angular speed around the molten metal pouring out point P.

The pouring apparatus 1 may further comprise a distribution calculation unit 42 configured to calculate the amount of operation of the horizontal movement mechanism 21, the lifting mechanism 22, and the rotation mechanism 23 to acquire required tilt angular speed calculated by the controller 3, as illustrated in the portion (b) of FIG. 10, and accordingly appropriate automatic pouring of molten metal is achieved.

In addition, the molten metal pouring pattern described above includes information showing change in virtual tilt angular speed with elapsed time corresponding to at least an initial reaching time step, a stationary time step, a stable waiting time step, and an instruction region step (R1 to R4 in FIG. 12 described below). The controller 3 may calculate virtual tilt angular speed according to each of the initial reaching time step, the stationary time step, the stable waiting time step, and the instruction region step (a calculation method in each of S10, S20, S30, and S40 of FIG. 13 described below), and accordingly appropriate automatic pouring of molten metal is achieved.

Subsequently, the pouring apparatus 1 and the pouring method, described above, will be more specifically described. First, a method of correcting a flow rate of pouring of molten metal for each tilt angle of a cylindrical ladle (the ladle 2 in the portion (a) of FIG. 2 will be described, for example) will be described.

Figure 4:
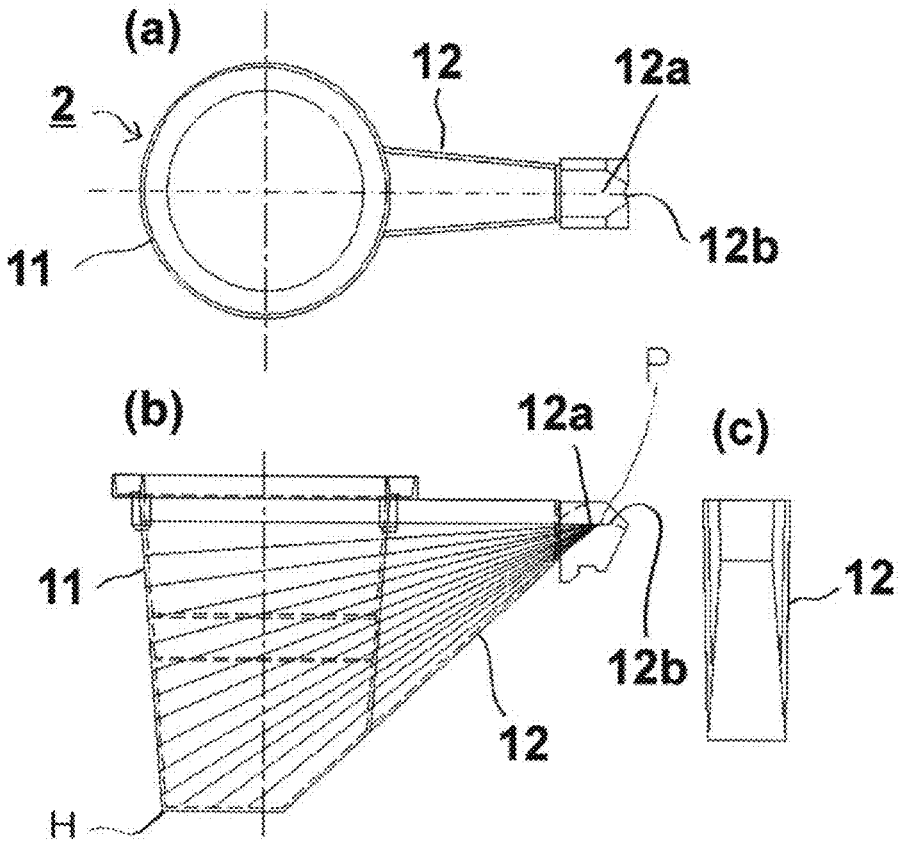
FIG. 4 includes a portion (a) that is a plan view of the ladle, a portion (b) that is a side sectional view of the ladle illustrating a molten metal pouring out point and tilt angle lines every four degrees around the molten metal pouring out point, and a portion (c) that illustrates the nozzle as viewed from the nozzle tip side.

A portion (a) of FIG. 4 is a plan view of the ladle 2, a portion (b) of FIG. 4 is a side sectional view of the ladle 2 illustrating a molten metal pouring out point P and tilt angle lines every four degrees around the molten metal pouring out point P, and a portion (c) of FIG. 4 illustrates the nozzle 12 as viewed from a nozzle tip 12*a* side. As illustrated in the portion (b) of FIG. 4, a surface area of the ladle 2 affecting a flow rate is changed for each tilt angle every four degrees around the molten metal pouring out point P. In addition, as illustrated in the portion (b) of FIG. 3, a surface area of the ladle 2 in a horizontal position can be approximately calculated by adding an area of a circle with a diameter A0 to an area of a trapezoid with an upper side E0, a lower side D0, and a height B0.

Figure 5:
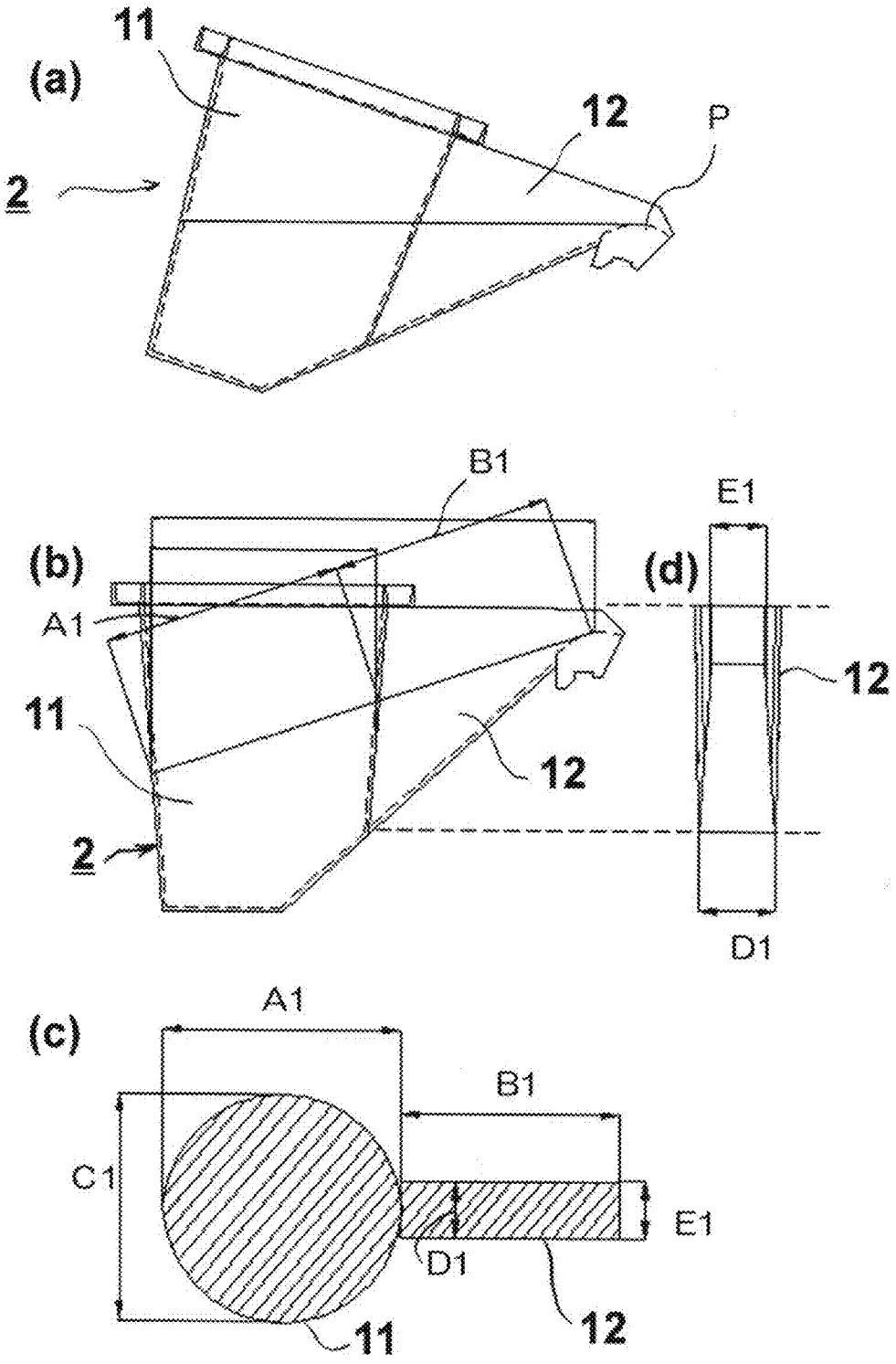
FIG. 5 includes a portion (a) that is a side sectional view of the ladle tilted by 16 degrees around the molten metal pouring out point, a portion (b) that illustrates a dimensional relationship of molten metal in a state of the portion (a), a portion (c) that illustrates a surface area of the molten metal, and a portion (d) that illustrates a dimensional relationship of the molten metal in the nozzle in the state of the portion (a).

A portion (a) of FIG. 5 is a side sectional view of the ladle 2 tilted by 16 degrees around the molten metal pouring out point P (referred to as "a tilt angle is 16-degree"), a portion (b) of FIG. 5 illustrates a dimensional relationship of molten metal in a state of the portion (a), a portion (c) of FIG. 5 illustrates a surface area of the molten metal, and a portion (d) of FIG. 5 illustrates a dimensional relationship of the molten metal in the nozzle 12 in the state of the portion (a). As illustrated in the portions (a) to (d) of FIG. 5, a surface area of the ladle 2 tilted by 16 degrees from the horizontal position around the molten metal pouring out point P can be approximately calculated by adding an area of an ellipse with a minor axis C1 and a major axis A1 to an area of a trapezoid with a upper side E1, a lower side D1, and a height B1. In this way, a surface area at each tilt angle every 4 degrees, for example, is calculated up to an inflection point H illustrated in FIG. 4 by a method similar to the above. While an example of tilt angles every 4 degrees is described for convenience of explanation, tilt angles may be every 1 degree or every 0.5 degrees for higher accuracy, and an surface area may be calculated for each tilt angle every further smaller angles.

Figure 6:
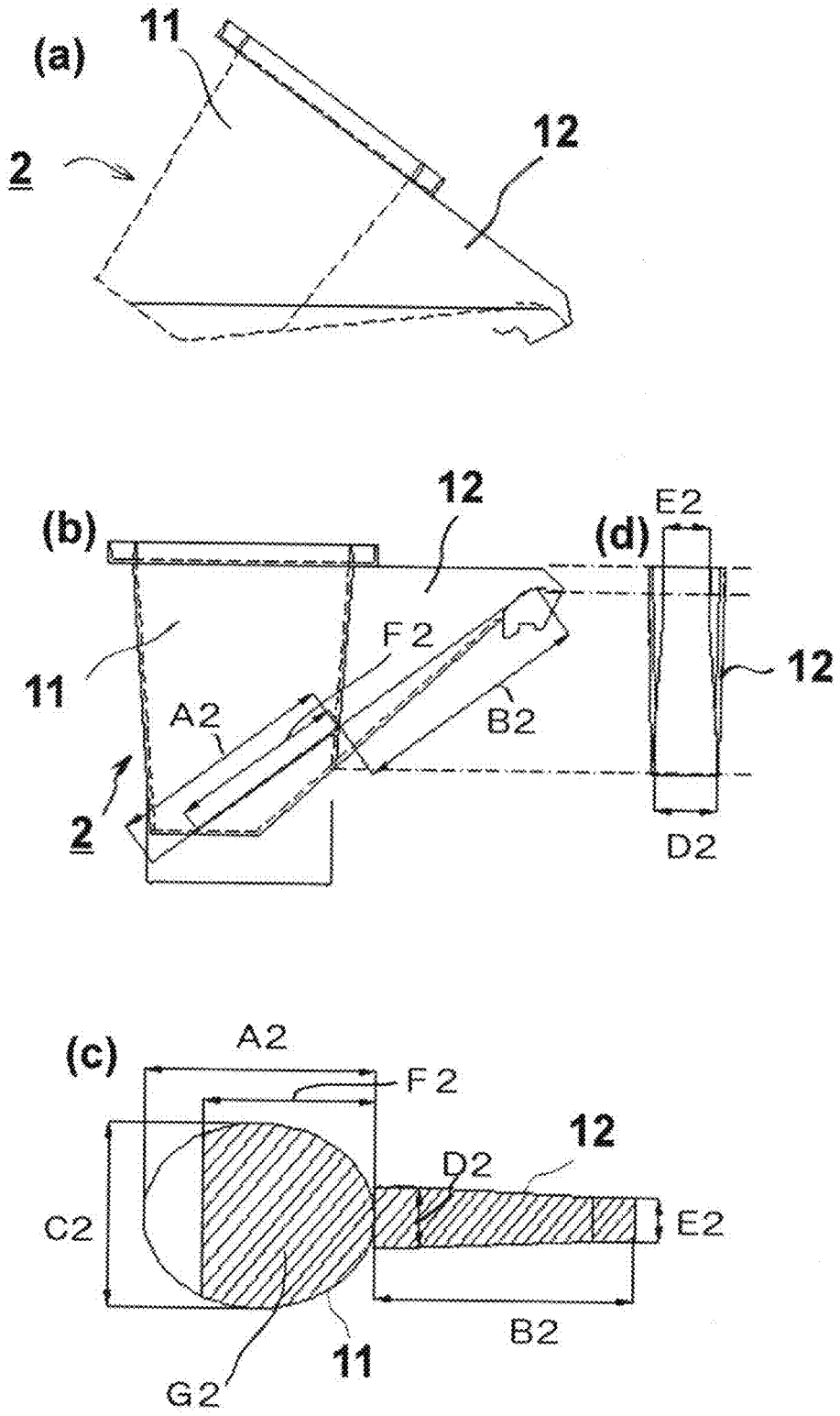
FIG. 6 includes a portion (a) that is a side sectional view of the ladle tilted by 56 degrees around the molten metal pouring out point, a portion (b) that illustrates a dimensional relationship of molten metal in a state of the portion (a), a portion (c) that illustrates a surface area of the molten metal, and a portion (d) that illustrates a dimensional relationship of the molten metal in the nozzle in the state of the portion (a).

A portion (a) of FIG. 6 is a side sectional view of the ladle 2 tilted by 56 degrees around the molten metal pouring out point P, a portion (b) of FIG. 6 illustrates a dimensional relationship of molten metal in a state of the portion (a), a portion (c) of FIG. 6 illustrates a surface area of the molten metal, and a portion (d) of FIG. 6 illustrates a dimensional relationship of the molten metal in the nozzle 12 in the state of the portion (a). That is, the portions (a) to (d) of FIG. 6 illustrate a tilted state exceeding the inflection point H illustrated in FIG. 4. As illustrated in the portions (a) to (d) of FIG. 6, a surface area of the ladle 2 tilted by 56 degrees from the horizontal position around the molten metal pouring out point P can be approximately calculated by adding a right area G2 of a portion divided by a straight line drawn in a portion within length F2 from a right edge of an ellipse with a minor axis C2 and a major axis A2 (length from a side wall surface of the ladle to molten metal positioned in a bottom face thereof) (length of a portion where the molten metal exists in the bottom face in a direction of the major axis) to an area of a trapezoid with a upper side E2, a lower side D2, and a height B2. A surface area of the ladle 2 from the inflection point H to an end point of allowing pouring of molten metal can be calculated by calculation similar to the above. In this way, a surface area for each of tilt angles at intervals of a minute angle (e.g. 4 degrees) can be calculated in the ladle 2.

Figure 11:
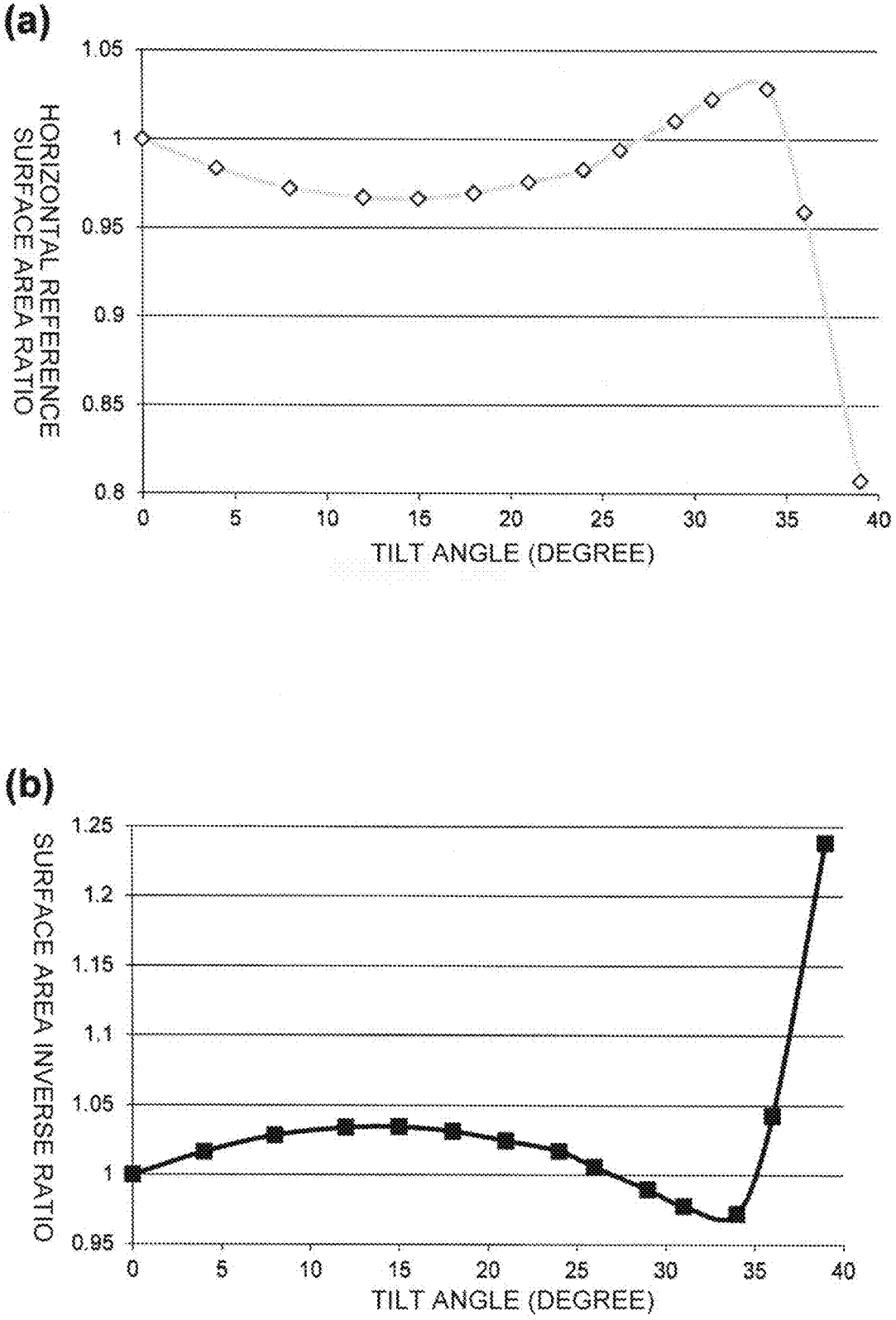
FIG. 11 includes a portion (a) that is a graph showing change in a horizontal reference surface area ratio with respect to a tilt angle, and a portion (b) that is a graph showing change in a surface area inverse ratio with respect to the tilt angle.

A portion (a) of FIG. 11 is a graph showing change in a horizontal reference surface area ratio with respect to a tilt angle. The horizontal reference surface area ratio is a surface area ratio with respect to a surface area of molten metal in a 0-degree state (horizontal state). As illustrated in the portion (a) of FIG. 11, a surface area of the ladle 2 gradually decreases, and increases from about 20 degrees. Then, the surface area sharply changes at the inflection point H, and subsequently decreases. A portion (b) of FIG. 11 is a graph showing change in a surface area inverse ratio with respect to the tilt angle. The surface area inverse ratio is a surface area inverse ratio with respect to a surface area of molten metal in a 0-degree state (horizontal state). An interval between tilt angles to be calculated may be reduced depending on a shape of the ladle 2. The surface area inverse ratio for each minute tilt angle can serve as a correction value (parameter) of a flow rate of pouring of molten metal.

Driving directions of the pouring apparatus 1 are illustrated in FIG. 9 described above. The pouring apparatus 1 is driven in the following directions: a θ-direction in which the ladle 2 is rotated around the center of gravity of the ladle 2; an X-axial direction in which the ladle 2 is moved back and forth; and a Z-axial direction in which the ladle 2 is moved up and down. Simultaneous operation in the driving directions described above allows operation of pouring of molten metal to be performed such that the ladle 2 is tilted around the molten metal pouring out point P. A rotation angle in the θ-direction is a tilt angle around the molten metal pouring out point P.

Figure 12:
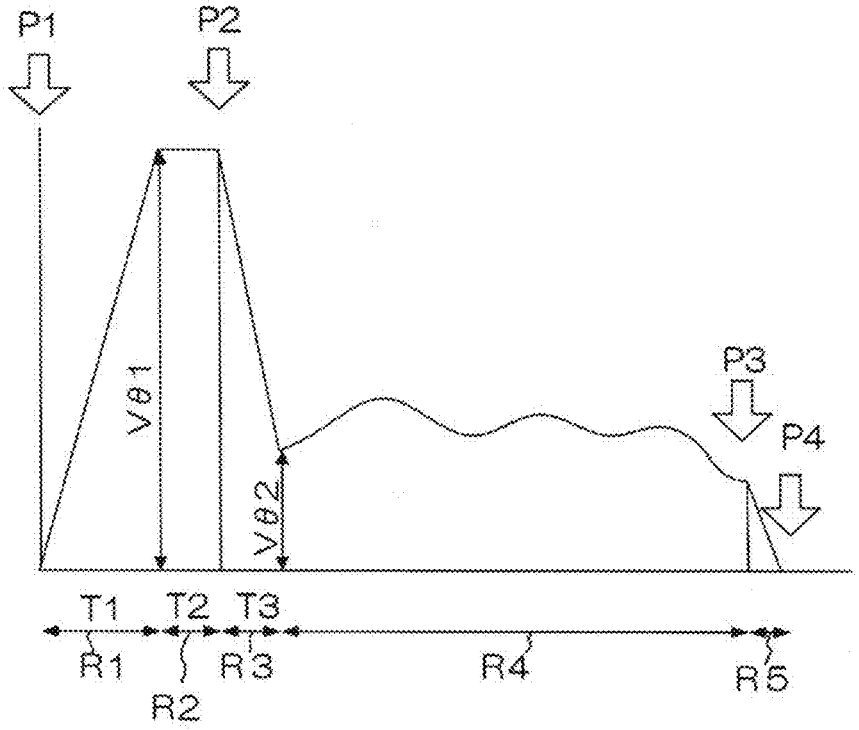
FIG. 12 is a graph showing change in virtual tilt angular speed with elapsed time.

FIG. 12 is a graph showing a relationship between angular speed (hereinafter referred to as "tilt angular speed") around the molten metal pouring out point P in a tilt direction and elapsed time. In FIG. 12, the vertical axis shows virtual tilt angular speed, and the horizontal axis shows elapsed time. Change in virtual tilt angular speed (change in virtual tilt angular speed with elapsed time) shown in FIG. 12 is change in tilt angular speed, required to perform suitable and desired operation of pouring of molten metal, if a ladle without change in a surface area of molten metal is used. In the description below, a tilt angle around the molten metal pouring out point P is indicated as a "tilt angle". A molten metal pouring pattern (flow rate pattern) is classified into regions R1 to R5 shown in FIG. 12. The region R1 is an "initial reaching time region", and the time is referred to as "initial reaching time T1" (time until angular speed reaches a preset tilt angular speed (reaches Vθ1)). The region R2 is a "constant-speed time region", and the time is referred to as "constant-speed time T2". The region R3 is a "stable waiting time region", and the time is referred to as "stable waiting time T3". The region R4 is an "instruction region". The region R5 is a "draining region".

In the region R1, a ladle is quickly tilted to near a pouring-out tilt angle from a state of starting pouring of molten metal. The state of starting pouring of molten metal is a state of an initial value or a state of a previous draining tilt angle. In the region R2, the ladle is operated at constant speed still at high speed. When the constant-speed time T2 elapses, the stable waiting time region R3 starts. In the region R3, tilt speed of the ladle is reduced until the instruction region R4 starts during the stable waiting time T3. In FIG. 12, P1 shows a start of pouring of molten metal, P2 shows a start of pouring out of molten metal, P3 shows draining of molten metal, and P4 shows an end of the pouring of molten metal.

In the region R4, from a start of instruction to an end of instruction, operation of pouring of molten metal is performed while instruction data described below is corrected for each minute time Δt (e.g. 0.2 second). In the region R5, when weight of poured molten metal reaches a preset weight, draining of molten metal is performed. The initial reaching time T1, the constant-speed time T2, the stable waiting time T3, the preset weight, and the instruction data are stored in the molten metal pouring pattern storage unit 32.

A portion (a) of FIG. 10 is a block diagram of a control system of the pouring apparatus 1. As illustrated in the portion (a) of FIG. 10, a fore-and-aft axis servo motor 21*a* of the horizontal movement mechanism 21, a lifting axis servo motor 22*a* of the lifting mechanism 22, a rotation axis servo motor 23*a* of the rotation mechanism 23, and a traveling car truck servo motor 24*a* of the traveling car truck 24 each drive each unit in response to a command from the controller (central processing unit) 3. Specifically, the controller 3 causes each of the servo motors 21*a*, 22*a*, 23*a*, and 24*a* to be driven through a lifting axis servo amplifier 22*b*, a fore-and-aft axis servo amplifier 21*b*, a rotation axis servo amplifier 23*b*, and a traverse axis servo amplifier 24*b*, connected to a power source 35, and a D/A conversion unit 38. A pulse command outputted by a pulse output unit or the like may be used. In addition, each of the servo amplifiers 21*b*, 22*b*, 23*b*, and 24*b* feeds back each piece of information described below to the controller 3 through a high-speed counter unit 37. The controller 3 also receives information from the weight detection unit (load cell) 13 through a load cell converter 13*a* and an A/D conversion unit 39. In addition, the controller 3 is connected to an operation unit (operation board) 34 to enable various kinds of operation as well as to cause an operation display 34*a* to display necessary information. The various servo motors each may be formed by attaching an encoder to an induction motor.

As illustrated in FIG. 10 (*b*), the controller 3 is provided in its storage region 3*a* with the state storage unit 45 that stores information on various states, in addition to the surface area information storage unit 31 and the molten metal pouring pattern storage unit 32, described above. In addition, the controller 3 is provided in its step and calculation region 3*b* with an initialization processing unit 40, a position and speed calculation unit 47, a tilt angular speed calculation unit 41, a tilt angular speed correction unit 48, a distribution calculation unit 42, and an instruction unit 43. The controller 3 controls each unit on the basis of information stored in the surface area information storage unit 31 and information stored in the molten metal pouring pattern storage unit 32. Calculation processing of the controller 3 enables tilt around the molten metal pouring out point P.

Figure 13:
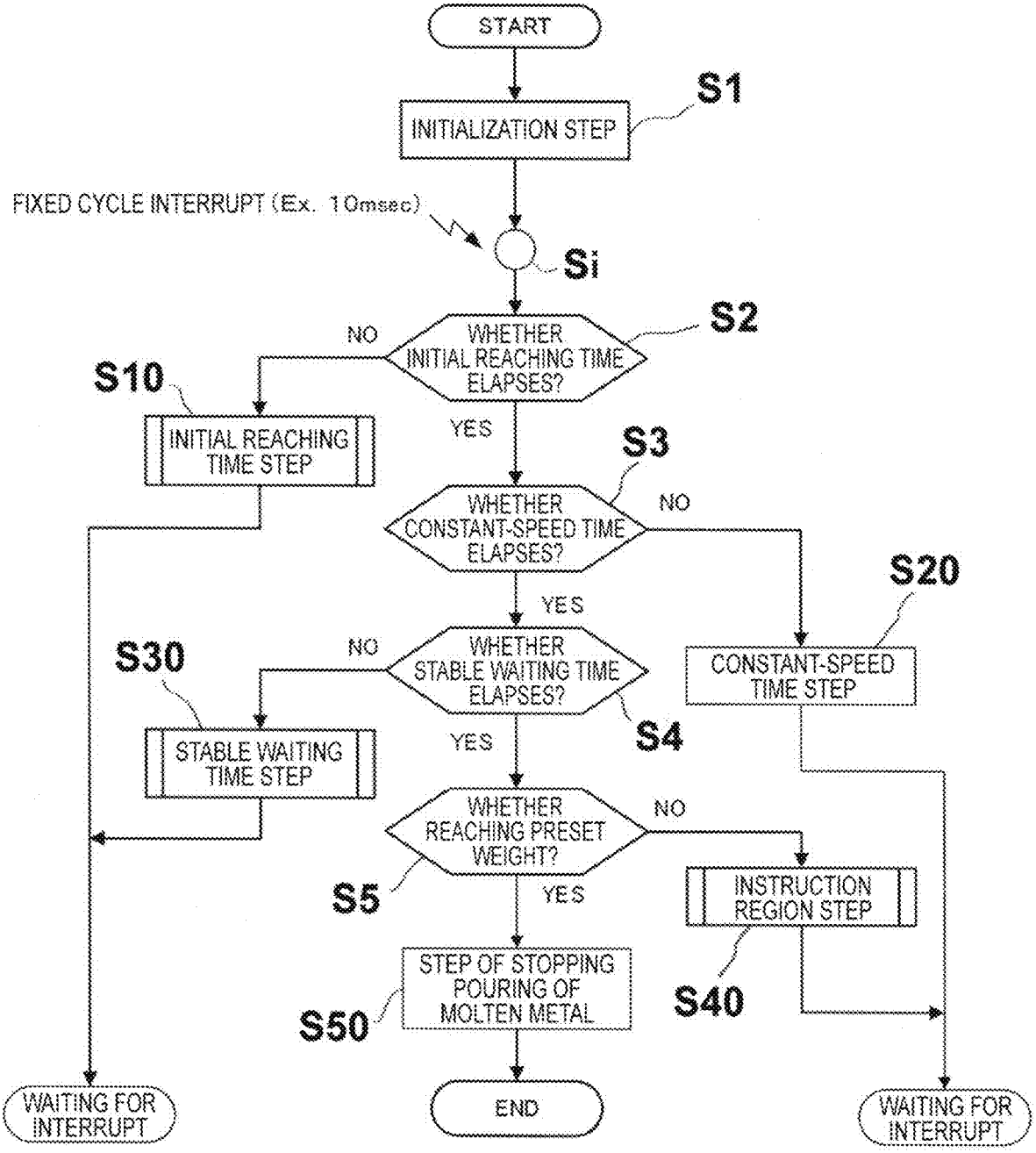
FIG. 13 is a general flow chart of a method of correcting a flow rate of pouring of molten metal, by the pouring apparatus.

FIG. 13 is a general flow chart of a method of correcting a flow rate of pouring of molten metal. As illustrated in FIG. 13, when pouring of molten metal is started, an initialization step is performed by the initialization processing unit 40 in step S1. The initialization processing unit 40 reads out various kinds of basic data stored in the state storage unit 45. After step S1, a fixed cycle interrupt is performed for each fixed scan time (e.g. 0.01 second) in step S1. Subsequently, processing proceeds to step S2.

In step S2, it is determined whether the initial reaching time T1 elapses. The initial reaching time T1 is read out from the molten metal pouring pattern storage unit 32. If the initial reaching time T1 elapses, the processing proceeds to step S3. If the initial reaching time T1 does not elapse, the processing proceeds to step S10. In step S10, the initial reaching time step is performed to wait for an interrupt.

In step S3, it is determined whether the constant-speed time T2 elapses. The constant-speed time T2 is read out from the molten metal pouring pattern storage unit 32. If the constant-speed time T2 elapses, the processing proceeds to step S4. If the constant-speed time T2 does not elapse, the processing proceeds to step S20.

In step S20, a constant-speed time step is performed to wait for an interrupt. The constant-speed time step is performed to maintain initial angular speed (final angular speed (Vθ1) in the initial reaching time step) for the constant-speed time T2 in the constant-speed time step.

In step S4, it is determined whether the stable waiting time T3 elapses. The stable waiting time T3 is read out from the molten metal pouring pattern storage unit 32. If the stable waiting time T3 elapses, the processing proceeds to step S5. If the stable waiting time T3 does not elapse, the processing proceeds to step S30. In step S30, the stable waiting time step is performed to wait for an interrupt.

In step S5, it is determined whether a weight of poured molten metal reaches the preset weight (preset weight of poured molten metal). The preset weight of poured molten metal is read out from the molten metal pouring pattern storage unit 32. If the weight of poured molten metal does not reach the preset weight, the processing proceeds to step S40. If the weight of poured molten metal reaches the preset weight, the processing proceeds to step S50. In step S40, the instruction region step is performed to wait for an interrupt. In step S50, a step of stopping pouring of molten metal, or draining, is performed to end the pouring of molten metal.

Figure 14:
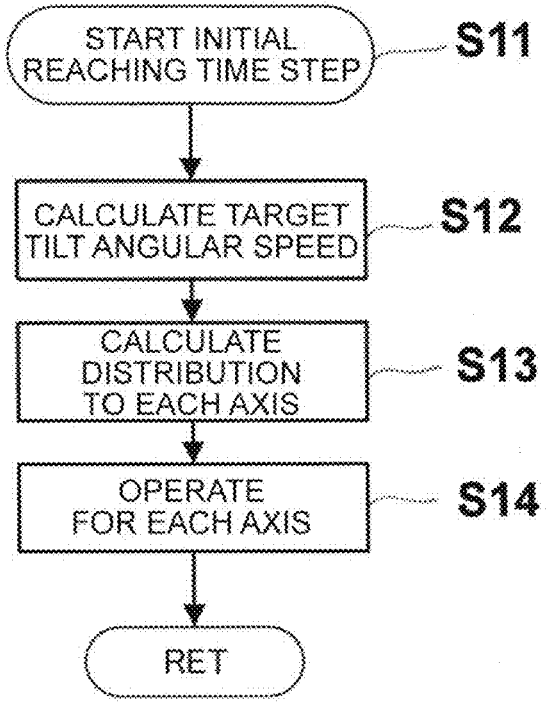
FIG. 14 includes a portion (a) that is a flow chart of an initial reaching time step S10 of FIG. 13, and a portion (b) that is a flow chart of a stable waiting time step S30 of FIG. 13.
Figure 14:
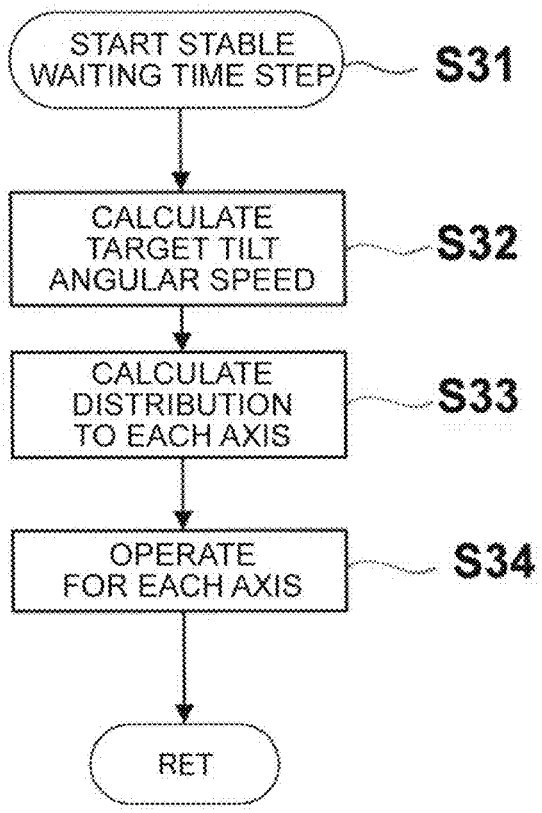

A portion (a) of FIG. 14 is a flow chart of the initial reaching time step in step S10. When this step is started in step S11, target tilt angular speed Vθ(t) is calculated in step S12. The tilt angular speed calculation unit 41 reads out the following: a current tilt angle θ(t) from the state storage unit 45; first preset angular speed Vθ1 from the molten metal pouring pattern storage unit 32; and a surface area inverse ratio Rp (θ(t)) corresponding to the current tilt angle θ(t) from the surface area information storage unit 31, and calculates target tilt angular speed Vθ(t) according to Expression (1), where "t" designates elapsed time (the horizontal axis of FIG. 12). The first preset angular speed Vθ1 is tilt angular speed to be targeted in a preset initial period. After the calculation in step S12, the processing proceeds to step S13.

$$V\theta(t)=(V\theta 1/T1)\times t\times Rp(\theta(t)) \quad (1)$$

In step S13, the distribution calculation unit 42 calculates distribution of the amount of operation (operation speed) to each axis to acquire desired tilt angular speed (Vθ(t)). Each axis refers to a horizontal direction (fore-and-aft direction (fore-and-aft axis)) being a driving direction of the horizontal movement mechanism 21, a lifting direction (lifting axis) being a driving direction of the lifting mechanism 22, and a rotation direction (a rotation direction around a rotation axis that is parallel to the Y-direction and passes through the center of gravity of a ladle) being a driving direction of the rotation mechanism 23. The distribution is calculated on the basis of the desired tilt angular speed (Vθ(t)) and data stored in the state storage unit 45 as data on speed and position, and is also stored in the state storage unit 45. The distribution calculation unit 42 calculates the distribution such that the ladle 2 is tilted around the molten metal pouring out point P. After the calculation in step S13, the processing proceeds to step S14.

In step S14, the instruction unit 43 instructs an each-axis operation unit 44 on the basis of data calculated by the distribution calculation unit 42. The each-axis operation unit 44 includes the servo amplifiers 21*b*, 22*b*, and 23*b*, the fore-and-aft axis servo motor 21*a*, the lifting axis servo motor 22*a*, and the rotation axis servo motor 23*a*, for example. That is, the instruction unit 43 instructs the fore-and-aft axis servo motor 21*a*, the lifting axis servo motor 22*a*, and the rotation axis servo motor 23*a*, respectively, through the servo amplifiers 21*b*, 22*b*, and 23*b*. The instruction unit 43 provides instructions based on speed data. A position in each axial direction is fed back from an encoder of each of the servo motors 21*a*, 22*a*, and 23*a*, and the high-speed counter unit 37, and is stored in the state storage unit 45. That is, the position and speed calculation unit 47 calculates positional information and speed information on the basis of information from each of the servo amplifiers 21*b*, 22*b*, and 23*b*, and causes the state storage unit 45 to store the information. When step S14 is ended, the processing returns to the general flow of FIG. 13, or to a state of waiting for an interrupt.

A portion (b) of FIG. 14 is a flow chart showing the stable waiting time in step S30. When this step is started in step S31, the target tilt angular speed Vθ(t) is calculated in step S32. The tilt angular speed calculation unit 41 reads out the following: a current tilt angle θ(t) from the state storage unit 45; second preset angular speed Vθ2 from the molten metal pouring pattern storage unit 32; and a surface area inverse ratio Rp (θ(t)) corresponding to the current tilt angle θ(t) from the surface area information storage unit 31, and calculates target tilt angular speed Vθ(t) according to Expressions (2) and (3). In Expression (3), SVθ(t) is virtual tilt angular speed, and is calculated by Expression (2). The second preset angular speed Vθ2 is tilt angular speed to be set before the instruction step. After the calculation in step S32, the processing proceeds to step S33.

$$SV\theta(t)=[(V\theta 2-V\theta 1)/T3]\times[t-(T1+T2)]+V\theta 1 \quad (2)$$

$$V\theta(t)=SV\theta(t)\times Rp(\theta(t)) \quad (3)$$

In step S33, the distribution calculation unit 42 calculates distribution of the amount of operation (operation speed) to each axis to acquire desired tilt angular speed (Vθ(t)), as with step S13 described above. After the calculation in step S33, the processing proceeds to step S34.

In step S34, the instruction unit 43 instructs the each-axis operation unit 44 on the basis of data calculated by the distribution calculation unit 42, as with step S14 described above. That is, the instruction unit 43 instructs the fore-and-aft axis servo motor 21*a*, the lifting axis servo motor 22*a*, and the rotation axis servo motor 23*a*. In step S34, other processes similar to those described in step S14 are performed. When step S34 is ended, the processing returns to the general flow of FIG. 13, or to a state of waiting for an interrupt.

Figure 15:
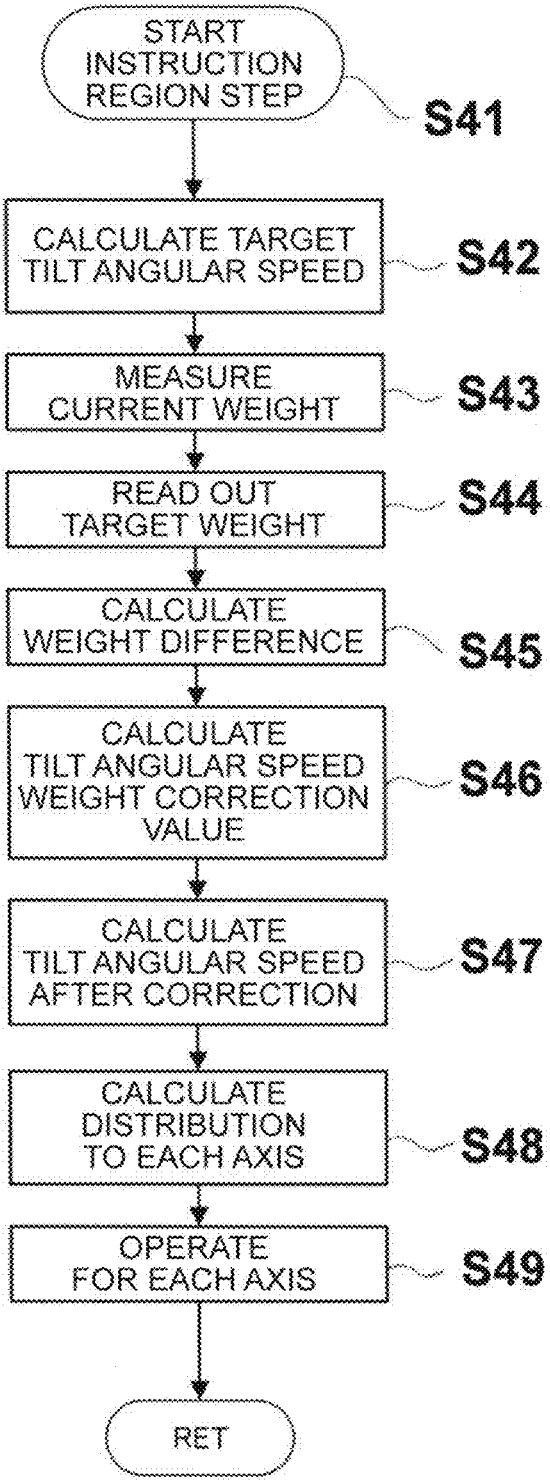
FIG. 15 is a flow chart of an instruction region step S40 of FIG. 13.

FIG. 15 is a flow chart showing instruction region in step S40. When this step is started in step S41, the target tilt angular speed Vθ(t) is calculated in step S42. The tilt angular speed calculation unit 41 reads out the following: a current tilt angle θ(t) from the state storage unit 45; preset instruction tilt angular speed VθT(t) from the molten metal pouring pattern storage unit 32; and a surface area inverse ratio Rp (θ(t)) corresponding to the current tilt angle θ(t) from the surface area information storage unit 31, and calculates target tilt angular speed Vθ(t) according to Expression (4). The preset instruction tilt angular speed VθT(t) stored in the molten metal pouring pattern storage unit 32 is so-called instruction data, and is virtual tilt angular speed every minute time. After the calculation in step S42, the processing proceeds to step S43.

$$V\theta(t)=V\theta T(t)\times Rp(\theta(t)) \quad (4)$$

In steps S43 to S47, the tilt angular speed correction unit 48 calculates a tilt angular speed weight correction value Vθg(t) for correcting weight difference, and corrects tilt angular speed for weight correction by using the value Vθg(t). The tilt angular speed after the weight difference is corrected is referred to as "tilt angular speed VθA(t) after correction".

In step S43, the tilt angular speed correction unit 48 reads out a current value W(t) of weight of poured molten metal from a poured molten metal weight measuring unit 49. Next, in step S44, the tilt angular speed correction unit 48 reads out target pouring molten metal weight Wobj after elapse of time "t" from the molten metal pouring pattern storage unit 32. Subsequently, in step S45, the tilt angular speed correction unit 48 calculates a weight difference ΔW(t) according to Expression (5).

$$\Delta W(t)=W\mathrm{obj}(t)-W(t) \quad (5)$$

Next, in step S46, the tilt angular speed correction unit 48 calculates the tilt angular speed weight correction value Vθg(t) for correcting the weight difference, according to Expression (6). In the meantime, the tilt angular speed correction unit 48 reads out a current tilt angle θ(t) from the state storage unit 45, and a surface area inverse ratio Rp (θ(t)) corresponding to the current tilt angle θ(t) from the surface area information storage unit 31. A reference character "a" below is a constant for calculating a tilt angle using a weight difference.

$$V\theta g(t)=a\times\Delta W(t)\times Rp(\theta(t)) \quad (6)$$

Subsequently, in step S47, the tilt angular speed correction unit 48 corrects tilt angular speed by using the value Vθg(t) according to Expression (7) to acquire tilt angular speed VθA(t) after correction. After the calculation in step S47, the processing proceeds to step S48.

$$V\theta A(t)=V\theta(t)+V\theta g(t) \quad (7)$$

In steps S42 to S47 described above, while the surface area inverse ratio Rp(θ(t)) is multiplied in each of Expressions (4) and (6), the calculation is not limited to this way. That is, the tilt angular speed VθA(t) after correction may be acquired by providing step S46*a* after steps S43 to S45 instead of step S46 without providing step S42, and by passing through subsequent steps S47*a* and S47*b* instead of step S47. In step S46*a*, a weight correction value for virtual tilt angular speed is calculated, or a weight correction value Vkg(t) for virtual tilt angular speed is calculated according to "a×ΔW(t)=Vkg(t)". In step S47*a*, virtual tilt angular speed after correction is calculated, or virtual tilt angular speed VθkA(t) after correction is calculated according to "VθT(t)+Vkg(t)=VθkA(t)". Here, preset instruction tilt angular speed VθT(t) may be read out in step S47*a* or in step prior to step S47*a*. In step S47*b*, tilt angular speed after correction is calculated, or tilt angular speed VθA(t) after correction is calculated according to "VθA(t)=VθkA(t)× Rp(θ(t))". Here, a surface area inverse ratio Rp(θ(t)) may be read out in step S47*b* or in step prior to step S47*b*. As described above, even steps S43 to S45, S46*a*, S47*a*, and S47*b* instead of steps S42 to S47 enable desired tilt angular speed VθA(t) after correction to be calculated.

In step S48, the distribution calculation unit 42 calculates distribution of the amount of operation (operation speed) to each axis to acquire the desired tilt angular speed VθA(t) after correction, as with step S13 described above. After the calculation in step S48, the processing proceeds to step S49.

In step S49, the instruction unit 43 instructs the each-axis operation unit 44 on the basis of data calculated by the distribution calculation unit 42, as with step S14 described above. That is, the instruction unit 43 instructs the fore-and-aft axis servo motor 21*a*, the lifting axis servo motor 22*a*, and the rotation axis servo motor 23*a*. In step S49, other processes similar to those described in step S14 are performed. When step S49 is ended, the processing returns to the general flow of FIG. 13, or to a state of waiting for an interrupt.

As described above, the pouring apparatus 1 achieves appropriate correction for a flow rate of pouring of molten metal, or appropriate automatic pouring of molten metal, by operation in each step of FIGS. 13 to 15. In addition, as described above, the pouring apparatus 1 achieves control of a flow rate of pouring of molten metal so that molten metal can be poured on a desired molten metal pouring pattern (flow rate pattern) even in a ladle (a ladle in which a surface area of molten metal changes in accordance with a tilt angle) other than a ladle (fan-shaped ladle) in which a surface area of molten metal is not changed even if the ladle is tilted. This enables automatization, improvement in work environment, energy saving, and improvement in quality to be achieved.

REFERENCE SIGNS LIST

1 . . . pouring apparatus, 2 . . . ladle, 3 . . . controller, 11 . . . body, 12 . . . nozzle, 12*a* . . . nozzle tip.

The invention claimed is:

1. A pouring apparatus for pouring by tilting a ladle such that a molten metal pouring position in which the molten metal is poured into a mold from a nozzle of the ladle is maintained at a predetermined position, comprising:

the ladle configured to include a body and the nozzle;

a controller configured to control a tilt angle of the ladle;

a surface area information storage unit storing a surface area of the molten metal that is calculated in accordance with the tilt angle of the ladle; and a state storage unit storing various states, wherein the body includes a side face portion, and an inner surface of the side face portion is formed in a cylindrical shape or in a conical shape, wherein the nozzle includes a nozzle tip provided at one end thereof and is integrated with the body on a side of the body, in order to guide the molten metal in the body to the nozzle tip and to pour out the molten metal through the nozzle tip, and wherein the controller is configured to:

read out a present tilt angle of the ladle stored in the state storage unit;

read out a surface area inverse ratio, from the surface area information storage unit, that corresponds to the read out present tilt angle;

calculate a tilt angular speed required for the ladle on the basis of the read out surface area inverse ratio and a predetermined preset angular speed; and control the tilt angle of the ladle such that a tilt angular speed is the calculated tilt angular speed.

2. The pouring apparatus according to claim 1, wherein the nozzle is formed such that i) a top surface shape of the molten metal stored in the nozzle is in a shape of a trapezoid or a rectangle as viewed from a vertical direction when the ladle is not tilted and ii) the top surface shape of the molten metal stored in the nozzle is in the shape of a trapezoid or a rectangle as viewed from the vertical direction when the ladle is tilted to pour out the molten metal through the nozzle tip.

3. The pouring apparatus according to claim 2, wherein the body has a top surface shape of the molten metal therein that is in a shape of an ellipse or an ellipse with a missing part when the ladle is tilted to pour out the molten metal through the nozzle tip, the missing part being due to the molten metal decreasing such that a bottom of the tilted body is no longer covered.

4. The pouring apparatus according to claim 1, further comprising:

a molten metal pouring pattern storage unit configured to store information on a molten metal pouring pattern corresponding to the mold, wherein the controller controls a tilt operation of the ladle such that the molten metal is poured into the mold on the molten metal pouring pattern corresponding to a kind of product on the basis of the information on the molten metal pouring pattern corresponding to the mold, stored in the molten metal pouring pattern storage unit, and information stored in the surface area information storage unit.

5. The pouring apparatus according to claim 4, wherein the body includes a second inner side face portion aligning with a bottom portion of the nozzle in a section orthogonal to a tilt center.

6. The pouring apparatus according to claim 5, wherein the nozzle tip is provided with a curved surface with a predetermined curvature radius for forming a flow of the molten metal, and wherein the ladle is tilted such that a curvature center of the curved surface serves as the tilt center.

7. The pouring apparatus according to claim 6, further comprising:

a horizontal movement mechanism configured to drive the ladle in a first direction that is a horizontal direction for approaching and separating from the mold;

a lifting mechanism configured to drive the ladle in a second direction that is a vertical direction; and a rotation mechanism configured to rotate the ladle around a rotation axis that is parallel to a third direction orthogonal to the first direction and the second direction, and that passes through a center of gravity of the ladle, wherein the controller is configured to control the horizontal movement mechanism, the lifting mechanism, and the rotation mechanism drive the ladle to tilt the ladle such that the curvature center serves as the tilt center.

8. The pouring apparatus according to claim 7, further comprising:

a weight detector configured to detect weight of the molten metal in the ladle, wherein the controller controls the tilt operation of the ladle by feedback control on the basis of information from the weight detector.

9. A pouring method for using a pouring apparatus for pouring by tilting a ladle such that a molten metal pouring position in which the molten metal is poured into a mold from a nozzle of the ladle is maintained at a predetermined position, the pouring apparatus comprising: i) the ladle configured to include a body and the nozzle; ii) a controller configured to control a tilt angle of the ladle; iii) a surface area information storage unit storing a surface area of the molten metal that is calculated in accordance with the tilt angle of the ladle; and iv) a state storage unit storing various states, wherein the body includes a side face portion, an inner surface of the side face portion is formed in a cylindrical shape or in a conical shape, wherein the nozzle includes a nozzle tip provided at one end thereof and is integrated with the body on a side of the body, in order to guide the molten metal in the body to the nozzle tip and to pour out the molten metal through the nozzle tip, and wherein the molten metal pouring, performs the method, via the controller, comprising:

reading out a present tilt angle of the ladle stored in the state storage unit;

reading out a surface area inverse ratio, from the surface area information storage unit, that corresponds to the read out present tilt angle;

calculating a tilt angular speed required for the ladle on the basis of the read out surface area inverse ratio and a predetermined preset angular speed; and controlling the tilt angle of the ladle such that a tilt angular speed is the calculated tilt angular speed.

10. The pouring method according to claim 9, wherein the ladle has an inner surface molded by using a mold for molding an inner surface of the body and the nozzle in a uniform shape.

11. A pouring apparatus for pouring by tilting a ladle such that a molten metal pouring position in which the molten metal is poured into a mold from a nozzle of the ladle is maintained at a predetermined position, comprising:

the ladle configured to include a body and the nozzle;

a controller controlling a tilt angle of the ladle;

a surface area information storage unit storing a surface area of the molten metal that is calculated in accordance with the tilt angle of the ladle; and a state storage unit storing various states, wherein the controller is configured to:

read out a present tilt angle of the ladle stored in the state storage unit;

read out a surface area inverse ratio, from the surface area information storage unit, that corresponds to the read out present tilt angle;

calculate a tilt angular speed required for the ladle on the basis of the read out surface area inverse ratio and a predetermined preset angular speed; and control the tilt angle of the ladle such that a tilt angular speed is the calculated tilt angular speed.

12. The pouring apparatus according to claim 1, further comprising:

a molten metal pouring pattern storage unit storing information on a molten metal pouring pattern corresponding to the mold, wherein the controller is further configured to:

calculate a present virtual tilt angular speed from the molten metal pouring pattern stored in the molten metal pouring pattern storage unit, and wherein the tilt angular speed required for the ladle is calculated on the basis of the read out surface area inverse ratio, the predetermined preset angular speed, and the calculated preset virtual tilt angular speed.

13. The pouring apparatus according to claim 12, wherein the molten metal pouring pattern stored in the molten metal pouring pattern storage unit corresponds to the mold, and is information showing change in a virtual tilt angular speed with an elapsed time, and wherein the virtual tilt angular speed is angular speed in a case where a surface area of the mold is converted into a reference surface area on the basis of information on the surface area of the mold.

14. The pouring apparatus according to claim 12, further comprising:

a horizontal movement mechanism configured to drive the ladle in a first direction that is a horizontal direction for approaching and separating from the mold;

a lifting mechanism configured to drive the ladle in a second direction that is a vertical direction;

a rotation mechanism configured to rotate the ladle around a rotation axis that is parallel to a third direction orthogonal to the first direction and the second direction, and that passes through a center of gravity of the ladle; and a distribution calculation unit configured to calculate an amount of operation of the horizontal movement mechanism, the lifting mechanism, and the rotation mechanism to acquire the tilt angular speed calculated by the controller.

15. The pouring apparatus according to claim 14, wherein the molten metal pouring pattern includes information showing change in a virtual tilt angular speed with an elapsed time corresponding to at least an initial reaching time step, a stationary time step, a stable waiting time step, and an instruction region step, and wherein the controller is further configured to calculate the virtual tilt angular speed according to each of the initial reaching time step, the stationary time step, the stable waiting time step, and the instruction region step.

16. The pouring apparatus according to claim 11, further comprising:

a molten metal pouring pattern storage unit storing information on a molten metal pouring pattern corresponding to the mold, wherein the controller is further configured to:

calculate a present virtual tilt angular speed from the molten metal pouring pattern stored in the molten metal pouring pattern storage unit, and wherein the tilt angular speed required for the ladle is calculated on the basis of the read out surface area inverse ratio, the predetermined preset angular speed, and the calculated preset virtual tilt angular speed.

17. The pouring apparatus according to claim 16, wherein the molten metal pouring pattern stored in the molten metal pouring pattern storage unit corresponds to the mold, and is information showing change in a virtual tilt angular speed with an elapsed time, and wherein the virtual tilt angular speed is angular speed in a case where a surface area of the mold is converted into a reference surface area on the basis of information on the surface area of the mold.

18. The pouring apparatus according to claim 16, further comprising:

a horizontal movement mechanism configured to drive the ladle in a first direction that is a horizontal direction for approaching and separating from the mold;

a lifting mechanism configured to drive the ladle in a second direction that is a vertical direction;

a rotation mechanism configured to rotate the ladle around a rotation axis that is parallel to a third direction orthogonal to the first direction and the second direction, and that passes through a center of gravity of the ladle; and a distribution calculation unit configured to calculate an amount of operation of the horizontal movement mechanism, the lifting mechanism, and the rotation mechanism to acquire the tilt angular speed calculated by the controller.

19. The pouring apparatus according to claim 18, wherein the molten metal pouring pattern includes information showing change in a virtual tilt angular speed with an elapsed time corresponding to at least an initial reaching time step, a stationary time step, a stable waiting time step, and an instruction region step, and wherein the controller is further configured to calculate the virtual tilt angular speed according to each of the initial reaching time step, the stationary time step, the stable waiting time step, and the instruction region step.

* * * * *